US005494216A

United States Patent [19]

Van Suntenmaartensdijk

[11] Patent Number: 5,494,216

[45] Date of Patent: Feb. 27, 1996

[54] BOX WITH POURING SPOUT

[76] Inventor: Bernardus J. Van Suntenmaartensdijk, Langebuurt 15, Uitgeest, Netherlands, 1911 AS

[21] Appl. No.: 256,541

[22] PCT Filed: Nov. 9, 1992

[86] PCT No.: PCT/NL92/00199

§ 371 Date: Jul. 13, 1994

§ 102(e) Date: Jul. 13, 1994

[87] PCT Pub. No.: WO93/13995

PCT Pub. Date: Jul. 22, 1993

[30] Foreign Application Priority Data

Jan. 16, 1992 [NL] Netherlands ..... 9200075
May 20, 1992 [NL] Netherlands ..... 9200887

[51] Int. Cl.[6] ..... B65D 5/74

[52] U.S. Cl. ..... 229/215; 229/210

[58] Field of Search ..... 229/125.42, 204, 229/210, 215, 248

[56] References Cited

U.S. PATENT DOCUMENTS

| | | | |
|---|---|---|---|
| 1,679,237 | 7/1928 | Birnbaum | 229/215 |
| 2,338,260 | 1/1944 | Ringler | 229/215 |
| 2,509,289 | 5/1950 | Dunning | 229/215 |
| 2,818,207 | 12/1957 | Wilson | 229/125.42 |
| 2,842,302 | 7/1958 | Ryder | 229/215 |
| 3,131,847 | 5/1964 | Desmond | 229/215 |
| 3,262,627 | 7/1966 | Kersh et al. | 229/125.42 |
| 3,404,828 | 10/1968 | Whipperman . | |
| 3,692,227 | 9/1972 | Hennessey et al. | 229/215 |
| 4,356,951 | 11/1982 | Sharp | 229/125.42 |

FOREIGN PATENT DOCUMENTS 1171348 1/1959 France .

*Primary Examiner*—Allan N. Shoap
*Assistant Examiner*—Christopher J. McDonald
*Attorney, Agent, or Firm*—Evenson, McKeown, Edwards & Lenahan

[57] ABSTRACT

A carton has a pour spout located at the edge of two side walls. The spout is formed by two cut lines which extend from the edge into each of the side walls. The spout also consists of four folds lines which cooperate to allow the spout to flex outwardly when opened. The fold lines extend from the edge at positions above and below the cut lines and arc into the sidewalls to a junction with the cut lines.

14 Claims, 5 Drawing Sheets

BOX WITH POURING SPOUT

The invention relates to a container, manufactured from foldable material and provided on an edge line with a pouring spout, wherein the pouring spout is formed by:

a first cutting line which extends in a first surface adjoining the edge line from a first point on the edge line;

a second cutting line which extends in a second surface adjoining the edge line from a first point on the edge line;

a first score line which extends in the first surface adjoining the edge line from a second point on the edge line and which terminates at the first cutting line;

a second score line which extends in the second surface adjoining the edge line from a second point on the edge line and which terminates at the second cutting line;

a third score line which connects a third point on the edge line to the end point of the first cutting line;

a forth score line which connects the third point on the edge line to the end point of the second cutting line;

in which the greatest distance between the third score line, respectively the fourth score line and the edge line is greater than the distance between the end point of the first score line on the first cutting line respectively the end point of the second score line on the second cutting line and the edge line.

Such a container is known from U.S. Pat. No. 3,404,828.

The third score line, the first cutting line and the edge line enclose a first pressing surface, while the fourth score line, the second cutting line and the edge line enclose a second pressing surface. By pressing inward both pressing surfaces, for instance by means of the thumb, the end points of the cutting line are moved apart so that both spout surfaces are capable of moving back to their original position.

This step has the result that when the pressing surfaces are moved back the top edge hereof drags with it the bottom edge of the spout surfaces so that the closing operation takes place.

Experience has learned that the closure of this prior art container is not always satisfactorily, and that the score lines wear out quickly.

The aim of the invention is to alleviate the problems encountered by the prior art. This aim is reached in that at least one point on the third score line being on a substantial distance from the first score line lies in the extension of the first score line and that at least one point on the fourth score line being on a substantial distance from the second score line lies in the extension of the second score line.

The fact that the imaginary extensions from the first and the second score lines terminate the third respectively the fourth score lines on a substantial distance from the cutting lines, implies that the pressing surfaces enclosed by the edge line, the cutting lines and the third, respectively the fourth score line have a certain width over this substantial distance.

Consequently these pressing surfaces may exert a spreading force on the termination points of the cutting lines which is sufficient to allow the surfaces to move back though their dead point to the original closed position. According to another preferred embodiment the greatest distance between the third score line, respectively the fourth score line and the edge line is greater than the distance between the intersection point of the first cutting line and the third score line, respectively the second cutting line and the fourth score line.

These steps have the result that when both pressing surfaces are depressed they automatically return to their starting position.

Other attractive preferred embodiments are elucidated in the appended sub-claims.

The invention will now be elucidated with reference to the annexed figures, in which.

Figure 1:
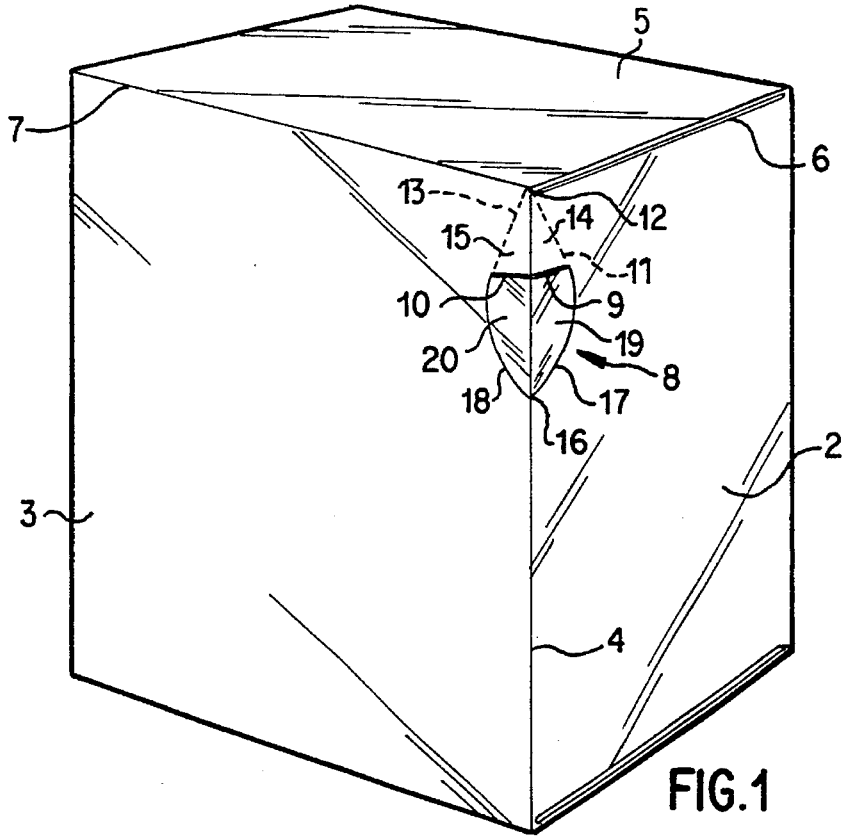
FIG. 1 shows a perspective view of a container which is provided with a pouring spout according to the present invention.

Shown in FIG. 1 is a container in the form of a box 1. Box 1 comprises a first side wall 2 and a second side wall 3 which are separated by an edge line or seam 4. The box of course comprises various walls, although these are not of importance for the invention and are therefore not discussed further. Box 1 further comprises an upper wall 5, wherein the separating wall between the top wall 5 and the first side wall 2 is formed by an edge line 6 and wherein the upper wall 5 is separated from the second side wall 3 by an edge line 7.

Arranged in the vertically extending edge line 4 is a pouring spout which is designated in its entirety with 8. The pouring spout is formed by a first cutting line 9 which extends from a first point on the edge line 4 into the first side wall 2 and a second cutting line 10 which extends from the same point on the edge line 4 into the second side wall 3. Both cutting lines 9, 10 preferably extend at an angle of substantially 90° relative to the edge line 4.

The end points of both cutting lines 9, 10 are connected by means of a first perforation line 11, which extends in the first side wall, to a second point on the edge line 6. It is noted here that the second corner point coincides with the corner 12 of box 1. From the relevant second point a second perforation line 13 extends further in the second side wall 3 to the end point of the second cutting line 10. A first spout surface 14 is enclosed by the edge line 4, the first cutting line 9 and the first perforation line 11, while a second spout surface 14 is enclosed by the edge line 4, the second cutting line 10 and the second perforation line 13.

From a third point 16 on edge line 4 a crease line 17 extends to the end point of the first cutting line 9. From the same third point 16 a second crease line 18 extends to the end point of the second cutting line 10. The two first crease lines 17, the first cutting line 9 and the edge line 4 enclose a first pressing surface 19, while the second crease line 18, the second cutting line 15 and the edge line 4 cut a second pressing surface 20.

It is possible to embody both perforation lines as another form of score line, for instance as a crease line. The same applies for the crease lines 17, 18; they can also be embodied as another type of score line, for example as a perforation line.

The choice of the type of score line will partly depend on the properties of the material of which the box 1 is made, generally therefore on the quality and thickness of the cardboard from which box I is manufactured.

In preference however the perforation lines take a less substantial form than the crease lines. This provides the best action.

Figure 2:
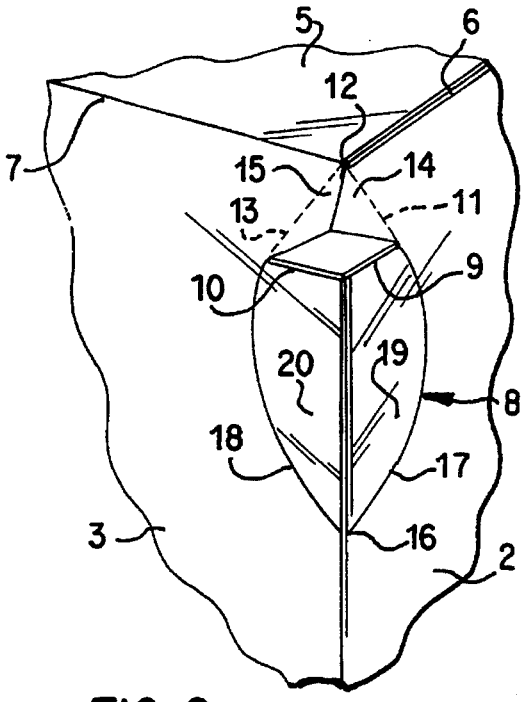
FIG. 2 shows a perspective detail view of the pouring spout depicted in FIG. 1 in the opened position.

By depressing the spout surfaces 14, 15, for instance with the index finger, the situation is obtained as shown in FIG. 2. In this situation it is possible to pour the granular material out of the obtained opening.

Figure 3:
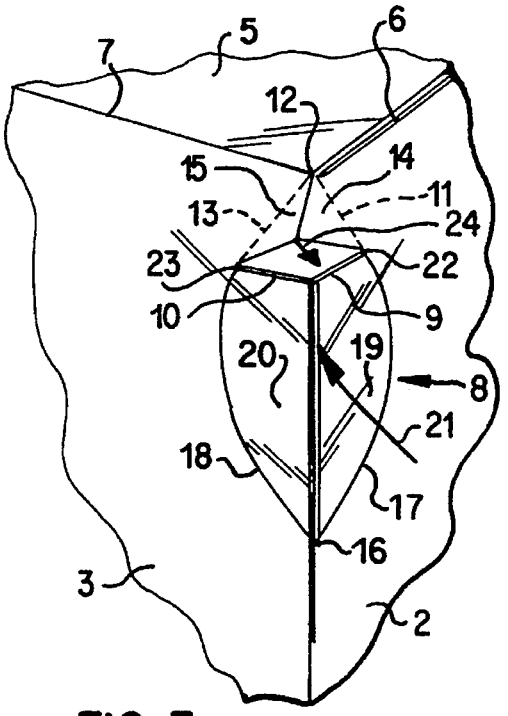
FIG. 3 shows a detail view corresponding with FIG. 2 during depressing of the pressing surfaces.

When after pouring the spout must be reclosed, a force is applied, again for instance by means of the index finger, to the first pressing surface and the second pressing surface as indicated with the arrow 21 in FIG. 3. The end points 22, 23 of the cutting lines will thereby be moved apart so that both spout surfaces 14, 15 can move back again to their original position. The movement of the spout surfaces 14, 15 is the direction indicated with arrow 24 is furthered by the fact that the upper edges of both pressing surface 19, 20 drag with them the lower edges of both spout surfaces 14, 15. Closure of this pouring spout is performed exceptionally easily without tinkering and without the risk of damaging the box. It should be noted here that the useful life of such a closure is of course limited, but this will be of less importance in practice; the pouring spout can take a robust form such that the box will be empty before the pouring spout is worn out.

Figure 4:
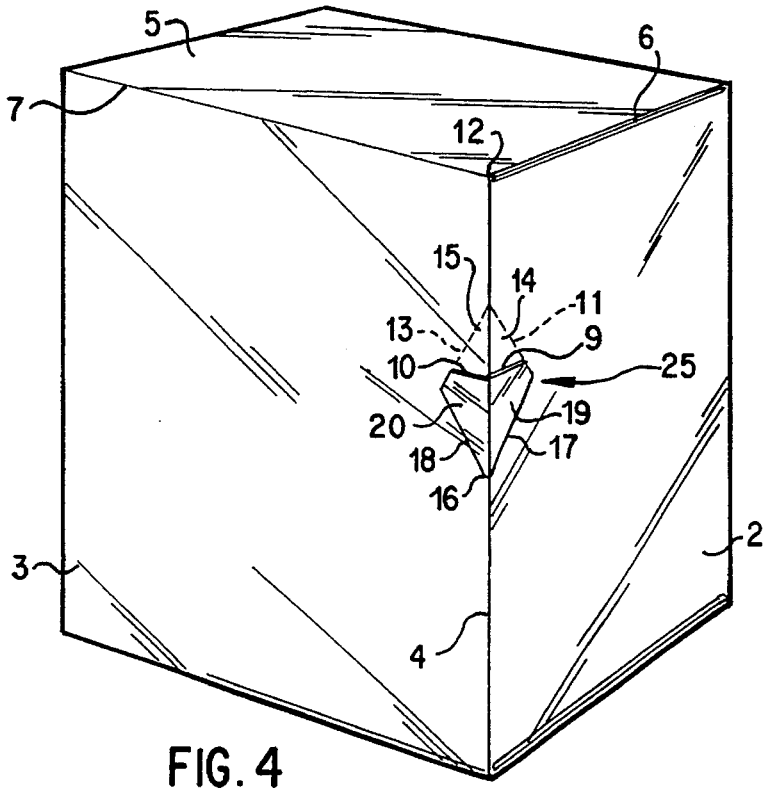
FIG. 4 is a perspective view of a second embodiment of the container with a pouring spout according to the invention.

In the embodiment of the invention shown in FIG. 4 an entire pouring spout 25 is displaced to a lower position on the edge line 4. This has no further consequences for the action of the pouring spout, with the proviso that it is easier to empty the box in the case of the first shown embodiment since in that case the last remnant of granular material flows along the pouring spout and remains in the box less easily.

The embodiment shown in FIG. 4 differs further in the fact that the shape of the crease lines 17, 18 is different; this takes an angular instead of a round form as in the first embodiment. The similarity between both embodiments lies in the fact that the largest width of the pressing surfaces is greater than the distance between the end points of the cutting lines. This step assists the return movement of the pressing surfaces to the starting position.

Figure 5:
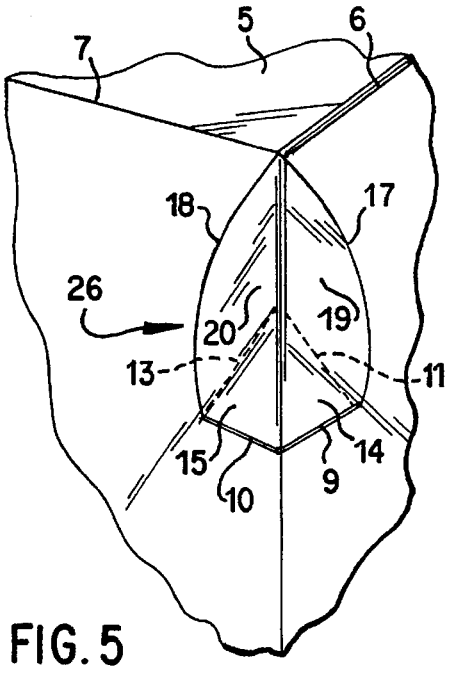
FIG. 5 is a perspective detail view of a second embodiment of the present invention.

FIG. 5 shows another embodiment, wherein the pressing surfaces 19, 20 are arranged on the other side of the spout surfaces 14 and 15 respectively. In this embodiment the surfaces 14, 15, 19 and 20 are pressed in with the finger, whereafter a pouring spout results which recloses after the finger is removed.

Figure 6:
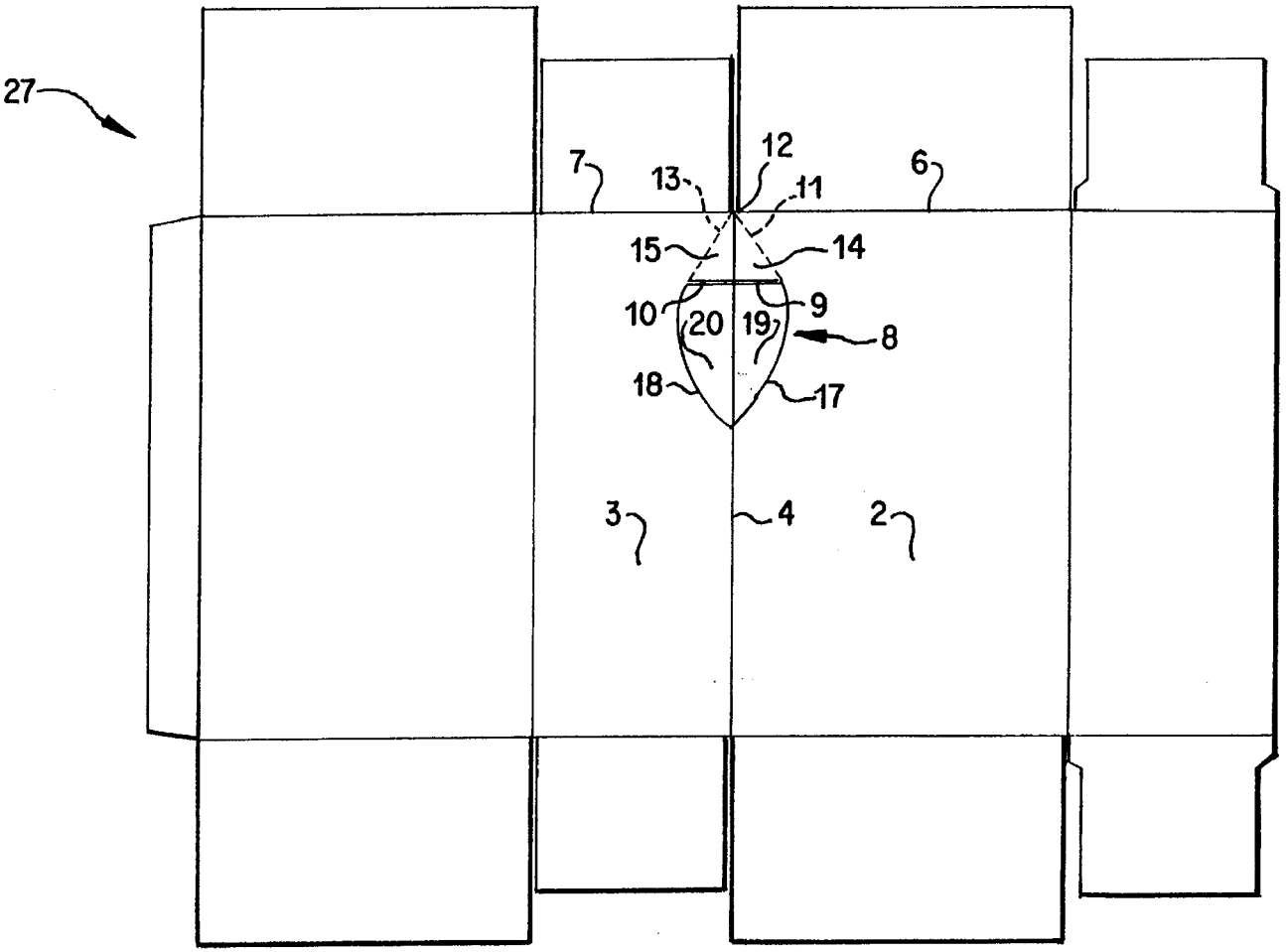
FIG. 6 is a top view of a blank from which the container of FIG. 1 can be manufactured.

FIG. 6 shows a blank 27 from which a box as according to FIG. 1 can be manufactured. It can be seen here that the box can be cut from a sheet of paper, cardboard or other material in a stamping/cutting/perforating operation, wherein the crease lines for forming the folds of the edge lines are formed simultaneously, while the perforation lines, crease lines and cutting lines required for the pouring spout according to the invention are also arranged.

Figure 7:
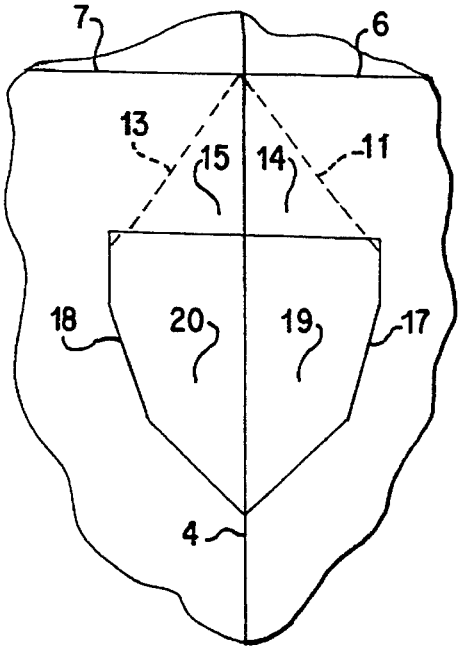
FIG. 7 is a detail view of a blank according to a third embodiment.

FIG. 7 shows a detail view of a blank of another embodiment. In this embodiment the perforation lines intersect the cutting lines inside the end point of the cutting line. This has the result that the width of the pressing surfaces is greater than the width of the spout surfaces. This step results in the spout surfaces being dragged along better by the pressing surfaces during the closing movement. In this embodiment the third and fourth score lines are moreover embodied in straight steps.

In the case of heavier material it is useful to locally perforate the edge line between the spout surfaces in order to facilitate pressing in of the spout.

Figure 8:
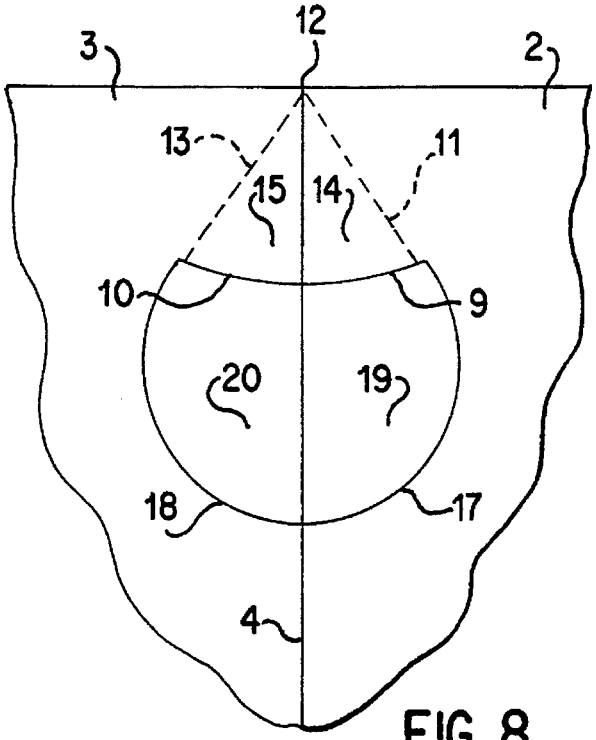
FIG. 8 shows a detail view of a blank of a fourth embodiment.

Finally, FIG. 8 shows an embodiment wherein the cutting lines 9, 10 between the spout surfaces 14, 15 and the pressing surfaces 19, 20 take a curved form. Due to the curved embodiment of these cutting lines the pouring opening becomes larger when the pouring spout is opened. This has the result that pouring material of larger dimensions, for instance chocolate flakes, can also pass easily through the pouring spout and blockages can be prevented. Instead of the curved embodiment of the cutting lines 9, 10 it is also possible to cause the cutting lines 9, 10 to run straight, not mutually in line but, as it were, angled downward. This also achieves a larger pouring opening. Such an embodiment is shown in FIG. 9.

Figure 9:
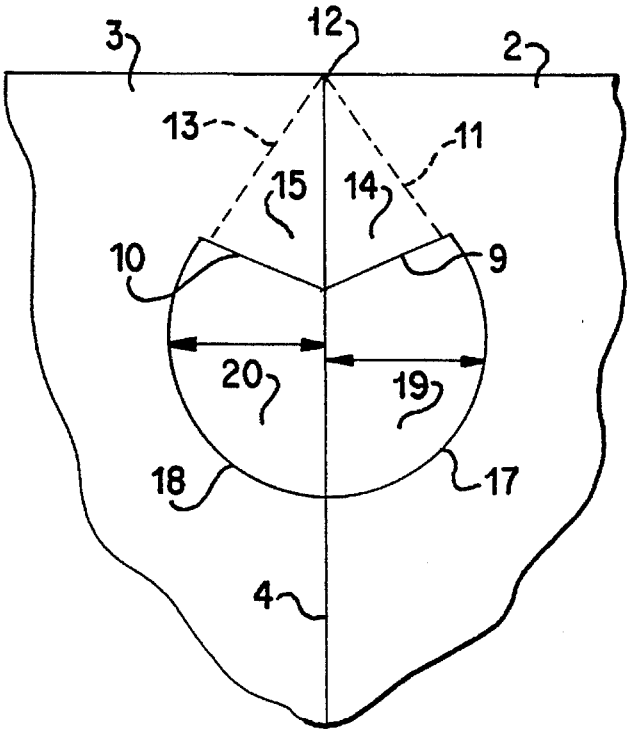
FIG. 9 shows a detail view of a blank of a fifth embodiment.

In the embodiments shown in FIG. 8 and 9 the crease lines 17, 18 take a curved form such that they both form part of a circle. This results in a greater stress on the pressing surface, whereby the return action is augmented.

The cutting lines 9, 10 also extend in both the shown embodiments beyond the intersection point with the lines 11, 13 in order to also obtain in this situation a better dragging along of the lips 14, 15 by the pressing surfaces 19, 20 when the spout is closed.

Figure 10:
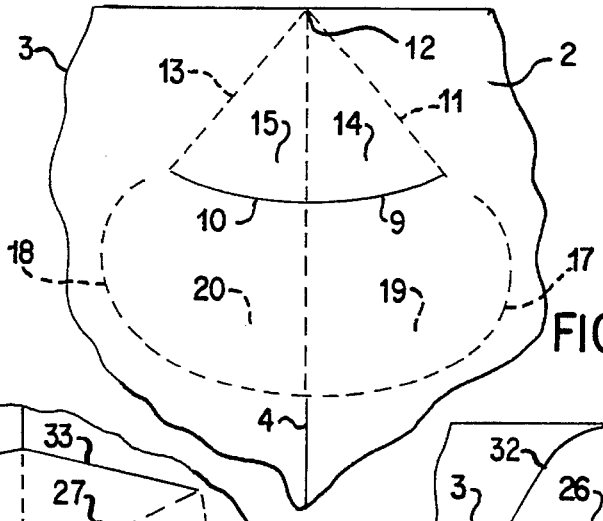
FIG. 10 is a detail view of a blank of a sixth embodiment.
Figure 11:
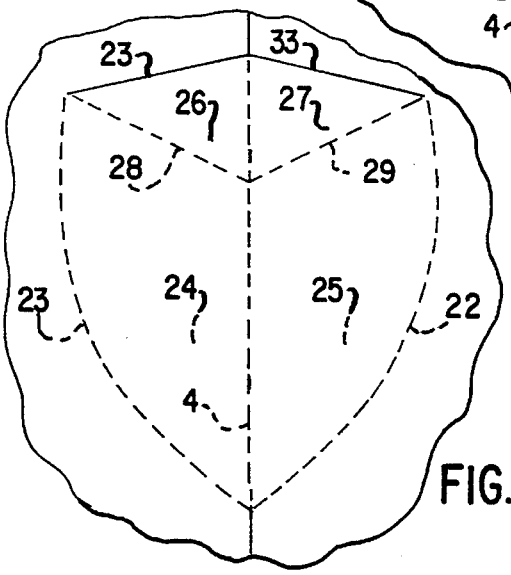
FIG. 11 shows a detail view of a blank of a seventh embodiment.

In the embodiment depicted in FIG. 10 the crease lines 17 and 18 intersect the crease lines 9 and 10 respectively at the position of the intersection point with the respective crease lines 11 and 13. As a result of this configuration the dragging effect as present in the embodiments of the figures 7, 8 and 9 is also present in the embodiment of FIG. 10; the same dragging effect is obtained in the return movement of the surfaces due to the exceptionally broad embodiment of the surfaces 19, 20.

The embodiments shown in FIG. 11, 12, 13 and 14 have another configuration which is similar to the embodiment shown in FIG. 5. In these embodiments all the lines shown in the drawing take the form of crease lines, although the bottom lines 22, 23 are formed as cutting lines. These embodiments comprise a pressing surface formed by four part-surfaces 24, 25, 26 and 27 which are divided by the fold line 4 and crease lines 28, 29. The surface 24 is bounded by the crease line 28 in addition to the fold line 4 and the crease line 23, while the pressing surface 25 is bounded by fold line 4, crease line 22 and crease line 29. The pressing surfaces 26 and 27 are both bounded by cutting lines 32, 33 respectively and crease lines 28, 29 respectively. The action of these embodiments is as follows. The pressing surface formed by the part-surfaces 24, 25, 26 and 27 can be depressed with a finger. Folds herein occur along the crease lines 2, 23, 28 and 29. The cutting lines 32, 33 open to a slit which can be used as pouring spout. The finger must herein be held on the pressing surface to keep the pouring spout opened. To cause the surfaces to return to their original position the finger is removed so that the stresses generated in the cardboard, particularly in the fold lines, urge the surfaces back to their original position. The embodiment according to FIG. 12 and 13 differ only in the form of the pressing surfaces and thus of the cutting and crease lines 32, 33, 22, 23, 28 and 29. The force required for depressing will therefore differ in different embodiments, this being caused by the different forces and stresses in the material.

Figure 12:
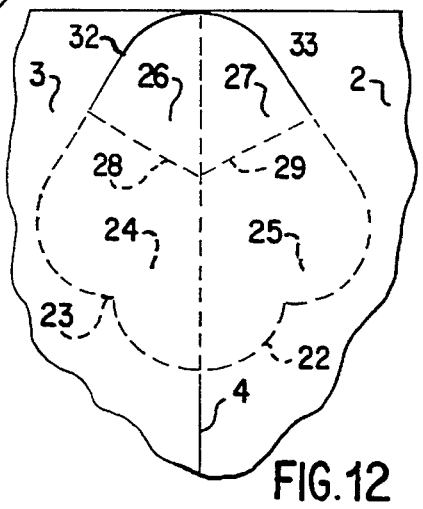
FIG. 12 shows a detail view of a blank of an eighth embodiment.
Figure 13:
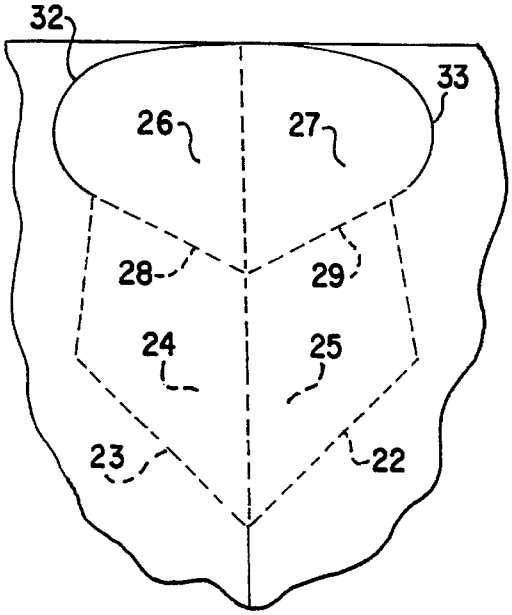
FIG. 13 shows a detail view of a blank of a ninth embodiment.
Figure 14:
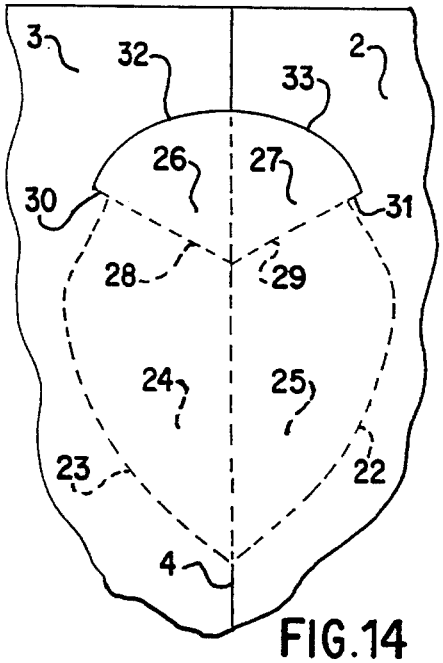
FIG. 14 is a detail view of a blank of a tenth embodiment.

The embodiment shown in FIG. 14 corresponds with the embodiment shown in FIG. 12 except for additional cutting lines 30, 31. These cutting lines are necessary due to the design.

It will also be apparent that the pouring spout according to the invention requires no extra material consumption. The pouring spout according to the invention can thus also be manufactured at a very low cost price.

I claim:

1. Container manufactured from foldable material and provided with a pouring spout on an edge line between a first panel and a second panel, said pouring spout comprising:

a first cutting line which extends into said first panel from a first point on the edge line;

a second cutting line which extends into said second panel from the first point on the edge line;

a first score line which extends into said first panel from a second point on the edge line and which terminates at the first cutting line;

a second score line which extends into said second panel from the second point on the edge line and which terminates at the second cutting line;

a third score line which connects a third point on the edge line to the end point of the first cutting line;

a fourth score line which connects the third point on the edge line to the end point of the second cutting line;

and wherein the greatest distance between each of the third score line and the fourth score line and the edge line is greater than the distance between the end point of each of the first score line on the first cutting line and the end point of the second score line on the second cutting line and the edge line, and wherein at least one point on the third score line is located a substantial distance from the first score line and lies in the extension of the first score line, and at least one point on the fourth score line is located a substantial distance from the second score line and lies in the extension of the second score line.

2. Container as claimed in claim 1, wherein the first and the second score lines terminate on the first, respectively the second cutting lines inside respective end points of these cutting lines.

3. Container as claimed in claim 1, wherein in that the cutting lines (9, 10) and the score lines (11, 13, 17, 18) are symmetrical with respect to the edge line (4).

4. Container as claimed in claim 1, wherein the intersection points of the cutting lines with the edge line lie at a greater distance from the upper edge of the container than the intersection points of the score lines with the cutting lines.

5. Container as claimed in claim 4, wherein both cutting lines are curved and both intersect the edge line at substantially a right angle.

6. Container as claimed in claim 5, wherein the cutting lines are straight.

7. Container as claimed in claim 1, wherein the first and the second score lines are more substantially weakened than the third and the fourth score lines.

8. Container as claimed in claim 7, wherein the first and the second score lines are formed by a perforation and that the third and the fourth score lines are formed by a crease.

9. Container as claimed in claim 1, wherein the third and the fourth score lines are curved.

10. Container as claimed in claim 1, wherein the third and the fourth score lines both form part of the same circle in the blank form.

11. Container as claimed in claim 1, wherein the second point on the edge line coincides with a corner of the container.

12. Container as claimed in claim 1, wherein the edge line between the first point and the second point is perforated.

13. A blank for a container manufactured from foldable material and provided with a pouring spout on an edge line between a first panel and a second panel, said blank comprising:

a first cutting line which extends into said first panel from a first point on the edge line;

a second cutting line which extends into said second panel from the first point on the edge line;

a first score line which extends into said first panel from a second point on the edge line and which terminates at the first cutting line;

a second score line which extends into said second panel from the second point on the edge line and which terminates at the second cutting line;

a third score line which connects a third point on the edge line to the end point of the first cutting line;

a fourth score line which connects the third point on the edge line to the end point of the second cutting line;

and wherein the greatest distance between each of the third score line and the fourth score line and the edge line is greater than the distance between the end point of each of the first score line on the first cutting line and the end point of the second score line on the second cutting line and the edge line, and wherein at least one point on the third score line is located a substantial distance from the first score line and lies in the extension of the first score line, and at least one point on the fourth score line is located a substantial distance from the second score line and lies in the extension of the second score line.

14. Container manufactured from foldable material and provided with a pouring spout on an edge line between a first panel and a second panel, said pouring spout comprising:

a first cutting line which extends into said first panel from a first point on the edge line;

a second cutting line which extends into said second panel from the first point on the edge line;

a first score line which extends into said first panel from a second point on the edge line and which terminates at the first cutting line;

a second score line which extends into said second panel from the second point on the edge line and which terminates at the second cutting line;

a third score line which connects a third point on the edge line to the end point of the first cutting line;

a fourth score line which connects the third point on the edge line to the end point of the second cutting line;

and wherein a point on the third score line which is located the greatest distance from the edge line, is located a substantial distance from the first score line and lies in the extension of the first score line;

and wherein a point on the fourth score line which is located the greatest distance from the edge line, is located a substantial distance from the second score line and lies in the extension of the second score line.

* * * * *